US005917779A

United States Patent [19]

Ralson et al.

[11] Patent Number: 5,917,779

[45] Date of Patent: Jun. 29, 1999

[54] TRANSFORMERLESS LED DRIVING CIRCUIT

[75] Inventors: James M. Ralson, Naperville; Gregory Jay Ramsey, Barrington, both of Ill.

[73] Assignee: Gabriel, Inc., Elgin, Ill.

[21] Appl. No.: 08/842,636

[22] Filed: Apr. 16, 1997

[51] Int. Cl.[6] ..... G04C 19/00; G04B 37/12; G09G 5/00

[52] U.S. Cl. ..... 368/83; 368/204; 368/241; 345/211

[58] Field of Search ..... 368/67, 82–84, 368/239–242; 315/194, 196, 200, 201, 206, 207, 227, 272, 273; 345/82, 608, 211

[56] References Cited

U.S. PATENT DOCUMENTS

| | | | |
|---|---|---|---|
| 3,602,795 | 8/1971 | Gunn | 321/15 |
| 3,869,641 | 3/1975 | Goldberg | 315/135 |
| 4,201,039 | 5/1980 | Marion | 368/241 |
| 4,342,947 | 8/1982 | Bloyd | 315/199 |
| 4,697,930 | 10/1987 | Roberts et al. | 368/82 |
| 4,908,569 | 3/1990 | Fest | 324/120 |
| 5,600,549 | 2/1997 | Cross | 363/46 |

*Primary Examiner*—Vit Miska
*Attorney, Agent, or Firm*—Trexler, Bushnell, Giangiorgi & Blackstone, Ltd.

[57] ABSTRACT

A transformerless oven timer which uses a 20 pin microcontroller connected to light emitting diodes. The microcontroller has 2 Kbytes of 8 bit read only memory and has software etched therein. The microcontroller can transfer power and voltage to the light emitting diodes when the oven is connected to, and powered by, an electrical outlet. The software etched into the microcontroller detects whether a resistor is connected to the microcontroller and converts a pin on the microcontroller from an input into an output. The software also synchronizes the microcontroller with the frequency of the electrical outlet to provide that the microcontroller keeps track of time. The transformerless oven timer also includes electrical circuitry connected to the microcontroller, where the electrical circuitry reduces the voltage and current provided to the microcontroller and to the light emitting diodes without using a transformer. The electrical circuitry also provides real resistance to reject noise from the electrical outlet.

19 Claims, 3 Drawing Sheets

TRANSFORMERLESS LED DRIVING CIRCUIT

BACKGROUND OF THE INVENTION

The present invention relates generally to electronic circuits which drive a digital display, and relates more specifically to a novel electronic circuit which adequately rejects noise and provides that a high voltage power source can power a light emitting diode without using a transformer.

Many modem household electronic devices and appliances include digital displays for communicating information and/or for allowing someone to operate the device or appliance. Examples of such devices and appliances include digital alarm clocks, video cassette recorders and ovens. One type of digital display which is often incorporated within these household devices and appliances is a light emitting diode. Before fairly recently, the use of a light emitting diode as a digital display has been reserved for those household devices and appliances which would not inherently provide that the light emitting diode be subjected to high temperatures. In other words, while it has long been possible to incorporate a light emitting diode within the electronic circuitry of devices such as common digital alarm clocks, it has not long been possible to incorporate a light emitting diode within the electronic circuitry of, for example, a household oven. However, manufacturers of light emitting diodes recently have been able to produce light emitting diodes having higher temperature ratings. Consequently, it is now possible to incorporate a light emitting diode within the electronic circuitry of devices and appliances which will necessarily subject the light emitting diode to high temperatures. For example, it is now possible to incorporate a light emitting diode within the electronic circuitry of a household oven, where the light emitting diode may be exposed to temperatures as high as 105 degrees Celsius.

The typical household electrical outlet in the United States provides AC voltage of about 120 Volts at a frequency of about 60 Hz. The typical household electrical outlet in most foreign countries provides AC current at an even higher voltage. Because a light emitting diode can handle only a fraction of the voltage which an electrical outlet provides, it is imperative to provide a substantial voltage drop from the electrical outlet to the light emitting diode. To this end, electronic circuits which incorporate a light emitting diode include one or more static power transformers (each of which consists of two or more tightly coupled inductors). Transformers are used instead of resistors to drop the voltage because light emitting diodes generally require too much current to light. While the transformers get their primary power supply from the AC electrical outlet and then do, in fact, successfully provide a suitable voltage output to the light emitting diode, transformers are relatively expensive, and therefore raise the overall cost of the electronic circuit.

To avoid having to incorporate a transformer within an electronic circuit which provides a digital display, it has been possible to utilize a Vacuum Fluorescent Display in place of a light emitting diode. A Vacuum Fluorescent Display requires less current than a light emitting diode, and still requires that a voltage drop be provided from the electrical outlet. Therefore, one or more voltage dropping resistors are typically provided in connection with the Vacuum Fluorescent Display. While the one or more voltage dropping resistors provide the necessary voltage drop, a resistor elevates in temperature as it drops voltage, and it is almost always desirable to minimize the internal heat generated within an electronic circuit. This is especially true when the electronic circuit is already within an environment which necessarily subjects the electronic circuit to extreme external temperatures, such as when the electronic circuit is incorporated within a household oven, as explained above.

Another way to avoid having to incorporate a transformer within an electronic circuit which provides a digital display is to utilize a duplex display and a clock chip. This type of circuit is disclosed in U.S. Pat. No. 4,697,930, and is used within some digital alarm clocks today. Within this type of circuit, alternate phases of the AC power line are current limited and half wave rectified and become the current source to run the light emitting diode digital display. The current does not go through a bridge rectifier or a regulator. However, the less expensive the light emitting diodes, the more current that is needed to brightly drive the light emitting diodes. Additionally, the type of circuit which utilizes a duplex display and a clock chip offers noise rejection which is substandard within many applications. As a result, it often remains more practical to instead use a transformer in order to obtain the correct current and voltage drop.

Therefore, in the past, it has not been possible to provide that a high voltage power source, such as a household electrical outlet, can power a light emitting diode without having to include at least one transformer in order to offer adequate noise rejection. Having to include a transformer raises the overall cost of the circuit.

Additionally, it has not been possible to provide an electronic circuit which can drive a digital display, and offer adequate noise rejection, without generating substantial heat within the electronic circuit.

For the foregoing reasons, there is a need for the present invention, and the present invention is directed to eliminate the problems encountered heretofore.

OBJECTS AND SUMMARY

In light of the problems encountered heretofore, a general object satisfied by the claimed invention may be to provide an inexpensive, transformerless electrical circuit which provides that a high voltage power source can effectively power a light emitting diode and provides adequate noise rejection.

Another object satisfied by the claimed invention may be to provide an electronic circuit which can drive a digital display without generating substantial heat within one or more voltage dropping resistors.

Briefly, and in accordance with the foregoing, the present invention envisions an electrical circuit for providing that an AC voltage power source can power at least one light emitting diode without needing a transformer connected therebetween. In accordance with the present invention, the electrical circuit comprises a programmed microcontroller in driving connection with the light emitting diode, and reactive drop circuitry connected to the programmed microcontroller and connectable to the AC voltage power source, wherein the reactive drop circuitry reduces, without using a transformer, the voltage and current transferred from the AC voltage power source to the light emitting element through the programmed microcontroller.

A preferred embodiment of the present invention envisions a transformerless oven timer on an oven where the transformerless oven timer comprises a 20 pin microcontroller connected to a plurality of light emitting diodes, where the microcontroller has 2 kilobytes of 8 bit Read Only Memory, and has software etched therein. The microcontroller can transfer power and voltage to the light emitting diodes when the oven is connected to, and powered by, an electrical outlet. The software etched into the microcontroller detects whether a resistor is connected to the microcontroller and converts a pin on the microcontroller from an input into an output. The software also synchronizes the microcontroller with the frequency of the electrical outlet to provide that the microcontroller keeps track of time. The transformerless oven timer also includes electrical circuitry connected to the microcontroller, where the electrical circuitry reduces the voltage and current which is provided to the microcontroller and to the light emitting diodes by the electrical outlet without utilizing a transformer. The electrical circuitry also provides real resistance to reject noise from the electrical outlet.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DETAILED DESCRIPTION OF A PREFERRED EMBODIMENT

Figure 1:
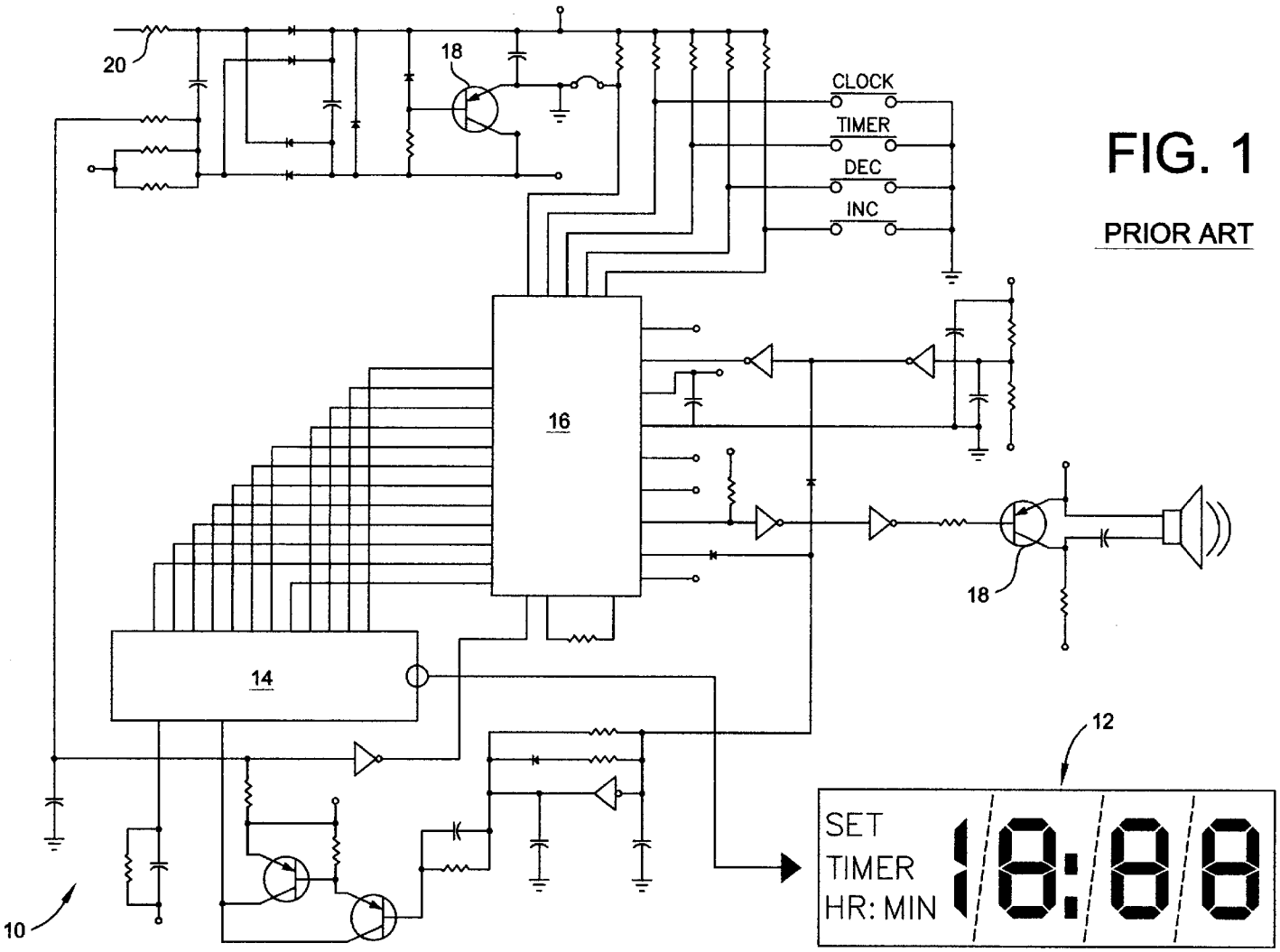
FIG. 1 PRIOR ART
FIG. 1 is a circuit diagram of a prior art oven timer including a voltage dropping resistor and a Vacuum Fluorescent Display.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

As explained hereinabove, transformers are relatively expensive, and therefore it is desirable to not have to include a transformer within a digital display circuit. As explained, a way to avoid having to include a transformer within a digital display circuit is to utilize a Vacuum Fluorescent Display instead of light emitting diodes. This type of circuit is shown in FIG. 1.

FIG. 1 shows a prior art electronic circuit 10 which operates and controls an oven timer digital display 12. The electronic circuit 10 includes a Vacuum Fluorescent Display 14 which is driven by a single microprocessor chip 16. The microprocessor chip 16 is programmed to handle clock functions, input/output functions, and display functions to drive the Vacuum Fluorescent Display 14 in a logical manner so that the correct information bout the time and operation of the oven is communicated to the user through the digital display 12. The microprocessor chip 16 is a forty-two pin microprocessor chip having a relatively large silicon die, large voltage output, and two kilobytes of ten bit Read Only Memory. For example, the microprocessor chip presently made by Hitachi and having model number HMCS412C is often used as element 16 within the electronic circuit 10 shown in FIG. 1.

The microprocessor chip 16 feeds its output to, among other elements, high voltage CMOS transistors 18. However, the electronic circuit 10 does not include a transformer, and a transformer is not needed within the electronic circuit 10 shown in FIG. 1 because the electronic circuit 10 uses a Vacuum Fluorescent Display 14 as the digital display 12. Unlike a light emitting diode, a Vacuum Fluorescent Display generally does not need much current to function properly. Therefore, instead of using a transformer, a voltage dropping resistor 20 is used to provide a voltage drop so that the correct voltage and current is provided both to the Vacuum Fluorescent Display 14 and to the microprocessor chip 16. The voltage dropping resistor 20 shown in FIG. 1 is a 2200 Ohm, ten watt resistor, and therefore generates substantial heat as it drops voltage.

The electronic circuit 10 provides an advantage because it avoids using a transformer to operate and power the digital display 12. As mentioned, the cost of transformers is relatively high, and therefore having to include a transformer within an electronic circuit generally increases the cost of the electronic circuit. However, a Vacuum Fluorescent Display is more generally more expensive than light emitting diodes. Additionally, the electronic circuit 10 still necessitates that a proper voltage drop be provided so that an appropriate voltage and current is provided both to the Vacuum Fluorescent Display 14 and to the microprocessor chip 16. To this end, as mentioned, the electronic circuit 10 uses the 2200 Ohm, ten watt voltage dropping resistor 20. Unfortunately, as mentioned, the voltage dropping resistor 20 substantially heats up while it provides this necessary voltage drop. In fact, the electronic circuit 10 provides that the voltage dropping resistor 20 dissipates about six watts in heat merely to run the clock of the digital display 12. It is desirable to minimize the internal heat created within an electronic circuit. This is especially true with respect to the electronic circuit 10 shown in FIG. 1 because the electronic circuit 10 operates and controls a digital display 12 on an oven. Therefore, the electronic circuit 10 is already subjected to extreme external temperatures which, in fact, may reach as high as 105 degrees Celsius.

It would be desirable to provide an electronic circuit which not only adequately rejects noise, but also provides that a high voltage power source can drive a light emitting diode without using a transformer. Additionally, it would be desirable to provide an electronic circuit which adequately rejects noise and which provides that a high voltage power source can drive a digital display without generating substantial heat within the electronic circuit. Before the present invention, neither has been possible. Fortunately, the present invention provides both advantages.

Figure 2:
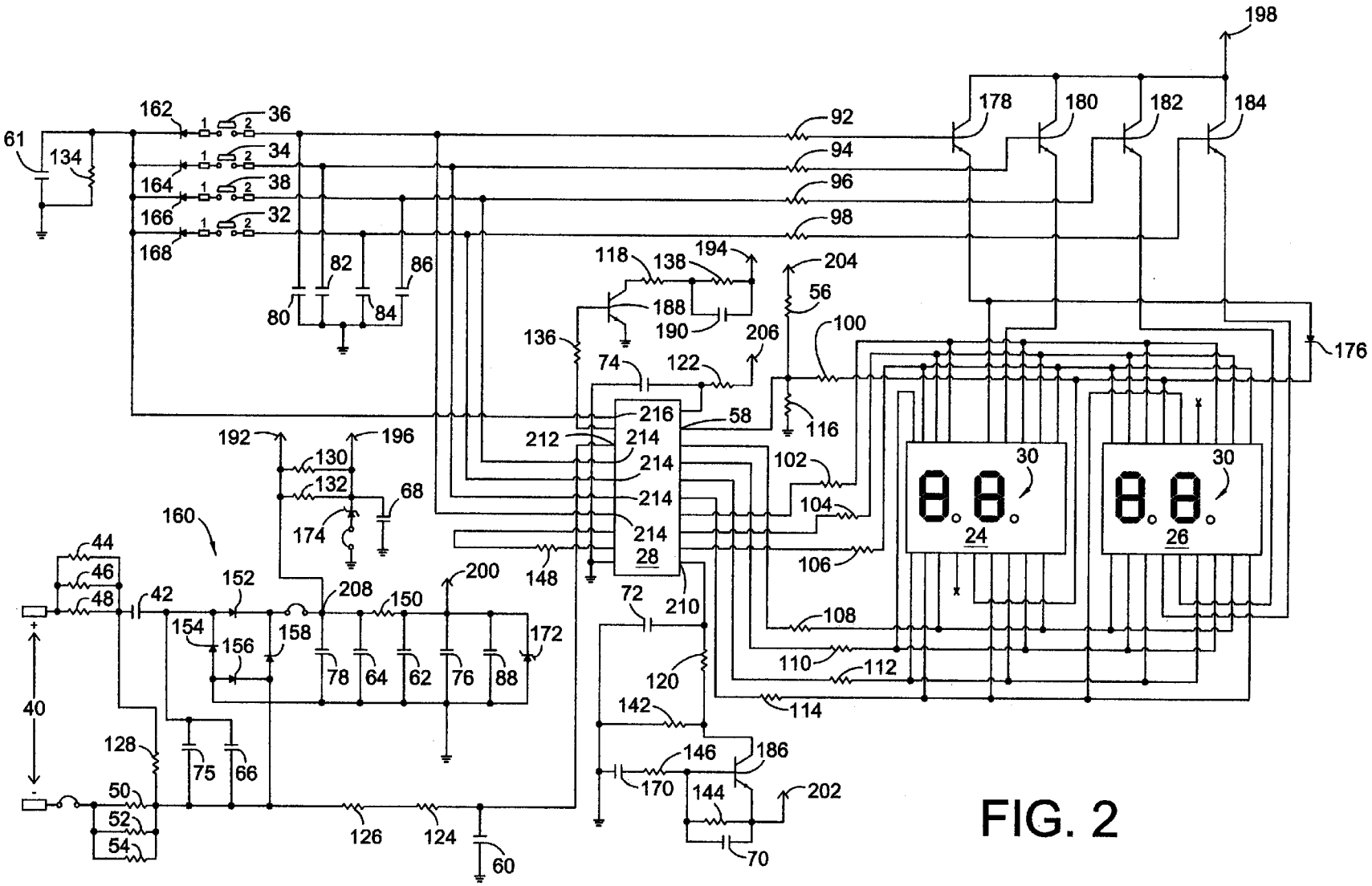
FIG. 2 is a circuit diagram of a novel electronic circuit structured in accordance with the present invention.
Figure 3:
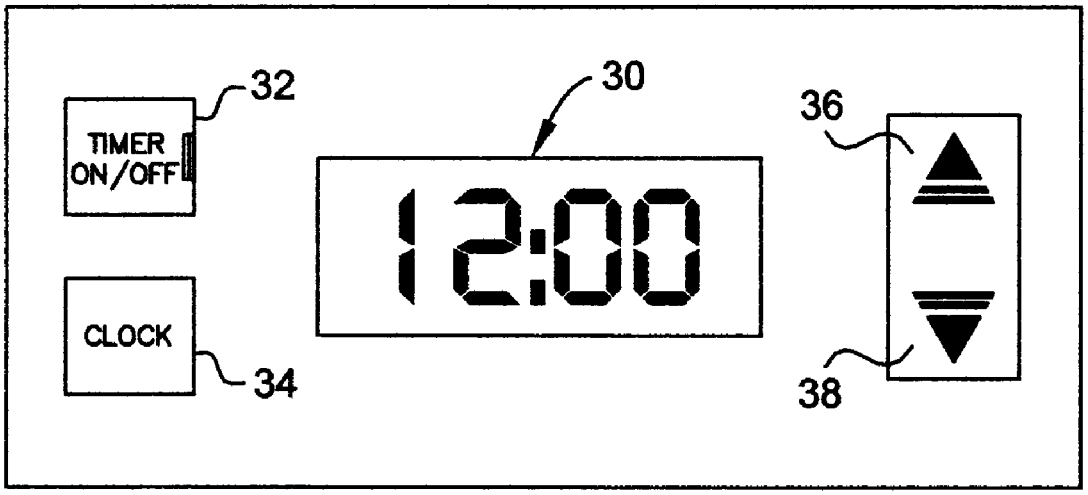
FIG. 3 is a view of an oven timer digital display controlled by the novel electronic circuit shown in FIG. 2.

Shown in FIG. 2 is an electronic circuit 22 structured in accordance with the present invention. The electronic circuit 22 is an oven timer circuit which powers and operates light emitting diodes 24 and 26 through a microprocessor chip 28. The light emitting diodes 24 and 26 form a digital display 30 on an oven as shown in FIG. 3 so that information regarding the time of day and operation of the oven itself can be communicated to the user. Additionally, the electronic circuit 22 also reads a plurality of input keys 32, 34, 36 and 38 on the oven so that the user can set the time, set a timer, and otherwise operate certain functions of the oven.

As shown in FIG. 2, the electronic circuit 22 does not include a transformer. Yet, the electronic circuit 22 provides that a 120 Volt AC, sixty Hertz power source 40, such as power that is typically received from an electrical outlet in the United States, can effectively power the light emitting diodes 24 and 26, which form the digital display 30 as shown in FIG. 3. Additionally, the electronic circuit 22 adequately rejects noise so that the electronic circuit 22 is appropriate for use in connection with the oven.

To provide these as well as other advantages, the electronic circuit 22 utilizes a reactive power drop. As shown in FIG. 2, the reactive power drop is provided within the electronic circuit 22 by providing a capacitor 42 having a specific value, at a location near the high voltage power source 40. The capacitor 42, because of its specific value, and because of its positioning within the electronic circuit 22, works to lower the AC voltage received from the high voltage power source 40 to the full wave bridge. Specifically, the impedance of the capacitor 42 is 1/377C where C is 2.7 microfarads. Therefore, the capacitor 42, at sixty Hertz, has ninety-five volts across it due to the reactance of the capacitor 42, and operates much like a resistor at sixty Hertz in creating a voltage drop. However, the capacitor 42 does not heat up like a voltage dropping resistor would. If the capacitor 42 were to be replaced with voltage dropping resistors in order to obtain the same effective voltage drop at sixty Hertz, the heat losses in the voltage dropping resistors would amount to between twelve and fifteen watts. This would result in substantial internal heat being generated within the electronic circuit 22, and this, as explained hereinabove, is not desirable. As a result, the electronic circuit 22 provides that a substantial voltage drop can be obtained from the high voltage power source 40 without providing that substantial heat needs to be generated within the electronic circuit 22. The reactive voltage drop of the present electronic circuit 20 provides that only about one hundred milliamps of current is supplied at a voltage of only about five volts. The value of the reactive voltage drop needed is relative to the value of the high voltage power source 40, and works to achieve the necessary current and voltages from the high voltage power source 40 which are needed to operate the microprocessor chip 28 and the light emitting diodes 24 and 26. The reactive voltage drop, and specifically, the value and positioning of the capacitor 42 within the electronic circuit 20, obviates the need for voltage dropping resistors which would otherwise be needed to provide this needed voltage drop. Unlike when voltage dropping resistors are used, the reactive voltage drop provided by the present electronic circuit 22 does not result in any heat being dissipated or any real power lost.

Furthermore, the reactive voltage drop, and specifically the capacitor 42, obviates the need to use a transformer to obtain the correct voltage and current drop and provide that the high voltage power source 40 can effectively power the light emitting diodes 24 and 26. As mentioned hereinabove, transformers are relatively expensive and usually raise the overall cost of a circuit. As a result, by eliminating the need to use a transformer, the capacitor 42 presents a substantial cost advantage. Another cost saving effect of utilizing the reactive power drop provided by the capacitor 42, and not using a transformer, is that a less expensive microprocessor chip 28 can be used within the electronic circuit 22 in order to drive the light emitting diodes 24 and 26. Specifically, a microprocessor chip 28 having less software selectable features and no high voltage outputs can be used. For example, a twenty pin microcontroller chip with two kilobytes of only eight bit Read Only Memory can be used, and specifically, the microprocessor chip presently produced by Samsung as model number KS57C0302 can be used. Presently, the Samsung chip model number KS57C0302 is one-third the price of the Hitachi chip model number HMCS412C which, as mentioned, is incorporated within the prior art electronic circuit 10 shown in FIG. 1.

Among other reasons, in order to increase overall noise rejection of the electronic circuit 22 shown in FIG. 2, the electronic circuit 22 includes real resistance near the high voltage power source 40 in addition to the reactive power drop provided by the capacitor 42. To provide real resistance near the high voltage power source 40, resistors 44, 46, 48, 50, 52 and 54 are provided, where each of the resistors 44, 46, 48, 50, 52 and 54 is a 300 Ohm, two watt resistor. The resistors 44, 46, 48, 50, 52 and 54 help the electronic circuit 22 reject noise. It is extremely important to provide that the electronic circuit 22 can adequately reject noise because the electronic circuit 22 is very sensitive to transient voltages, and substantial noise may come to the electronic circuit 22 through the high voltage power source 40, or even through other components of the typical household oven. For example, a modem gas oven often provides electronic ignition through operation of a high voltage transformer that draws a fairly large arc to ignite gas. In fact, this arc may be as high as one-quarter of an inch. Providing real resistance is necessary because the reactive power drop provided by the capacitor 42 is not much of an isolator of high voltage and high frequency transients. Additionally, the resistors 44, 46, 48, 50, 52 and 54 offer some serendipitous series inductance which helps insolate voltage spikes that may be received by the electronic circuit 22.

Another reason why real resistance is provided to the high voltage power source 40 is so that the capacitor 42 will not initially look like an instantaneous short to the sixty Hertz current coming in from the high voltage power supply 40 (impulse function). The real resistance is offered near the high voltage power supply 40 by utilizing the resistors 44, 46, 48, 50, 52 and 54 so that the current is limited, and does not surge at start up (t=0).

In the electronic circuit 22, resistor 56 is a ten kiloOhm resistor, and is present in the electronic circuit 22 if the electronic circuit 22 is expected to be run on sixty Hertz of current, such as is generally offered by electrical outlets in the United States. In contrast, the resistor 56 is not included in the electronic circuit 22 if the electronic circuit 22 is expected to be run on fifty Hertz of current, such as is generally offered by electrical outlets in most foreign countries. Preferably, the microprocessor chip 28 of the electronic circuit 22 has software etched therein so that the presence or absence of the resistor 56 can be detected. To this end, a pin 58 on the microprocessor chip 28 is initially configured, by way of the software etched within the microprocessor chip 28, so that the pin 58 operates as an input into the microprocessor chip 28. The software etched into the microprocessor chip then initially detects the digital level at pin 58 in order to determine whether the resistor 56 is present within the electronic circuit 22. Then, the software re-configures the pin 58 as an output from the microprocessor chip 28, and the microprocessor chip 28 drives the light emitting diodes 24 and 26 in a manner consistent with what the software etched within the microprocessor chip 28 has determined regarding the presence or absence of resistor 56 within the electronic circuit 22.

Additionally, preferably the software which is etched into the microprocessor chip 28 synchronizes with the frequency of the current coming in from the high voltage power source 40 so that the microprocessor chip 28 can keep accurate time, and provide that the light emitting diodes 24 and 26 which form the digital display 30 on the oven, accurately communicate this information regarding the time.

Specific values of the remaining elements of the electronic circuit 22 will now be disclosed. First, the values of each of the remaining capacitors within the electronic circuit 22 will be disclosed. Each of capacitors 60 and 61 is a one-thousandth microfarad capacitor. Each of capacitors 62, 64 and 66 is a one hundred picofarad capacitor. Capacitor 68 is a 100 microfarad, ten volt capacitor. Each of capacitors 70, 72, 74 and 75 is a one-tenth microfarad capacitor. Capacitor 76 is a four hundred seventy microfarad, ten volt capacitor. Capacitor 78 is a one thousand microfarad, thirty-five volt capacitor. Each of capacitors 80, 82, 84, 86 and 88 is a one-hundredth microfarad capacitor.

Next, the values of each of the remaining resistors within the electronic circuit 22 will be disclosed. Each of resistors 92, 94, 96, 98, 100, 102, 104, 106, 108, 110, 112 and 114 is a three hundred Ohm resistor. Resistor 116 is a one hundred kiloOhm resistor, and resistor 118 is a one hundred Ohm resistor. Each of resistors 120, 122 and 124 is a ten Ohm resistor. Each of resistors 126 and 128 is a one Megohm resistor. Each of resistors 130 and 132 is a two hundred Ohm, one watt resistor. Each of resistors 134 and 136 is a ten kiloOhm resistor. Resistor 138 is a 4.7 kiloOhm resistor, and each of resistors 140 and 142 is a 47 kiloOhm resistor. Resistor 144 is a twenty-two kiloOhm resistor, and resistor 146 is a 2.2 kiloOhm resistor. Finally, resistor 148 is a 61.6 kiloOhm resistor, and resistor 150 is a five hundred sixty Ohm resistor.

Next, the values of each diode within the electronic circuit 22 will be disclosed. Each of diodes 152, 154, 156 and 158 within the diode bridge 160 is a 1N4004 diodes. Each of diodes 162, 164, 166 and 168 is a 1N4148 diode. Diode 170 is a 1N5228, 2.7 volt Zener diode. Finally, each of diodes 172 and 174 is a 1N5352 Zener diode, and diode 176 is a timer light emitting diode.

Finally, the values of each of the transistors within the electronic circuit 22 will be disclosed and some remaining elements of the electronic circuit 22 will be described. Each of transistors 178, 180, 182 and 184 is a 2N4401 transistor, and each of transistors 186 and 188 is a 2N3906 transistor. Element 190 is a piezo beeper. Output 192 feeds input 194 amounting to an unregulated DC voltage source proving the current necessary to run the piezo beeper 190. Output 196 feeds input 198 amounting to a five volt DC voltage source providing the current necessary to power the light emitting diodes 24 and 26. Output 200 feeds inputs 202, 204 and 206 amounting to a five volt source giving the microprocessor chip 28 a solid five volt reference voltage which is free of variations due to the loading of the light emitting diodes 24 and 26. Output 200 also provides voltage to a few peripheral circuits (not shown).

Some aspects regarding operation of the electronic circuit 22 and interaction of the elements of the electronic circuit 22 will now be described. When voltage comes to the electronic circuit 22 through the high voltage power source 40, the input voltage is lowered through resistors 44, 46, 48, 50, 52 and 54 and through capacitor 42. The voltage is full wave rectified through the diode bridge 160 formed by the diodes 152, 154, 156 and 158, and is filtered by capacitor 78. Node 208 by the capacitor 78 supplies output 192 which provides current to input 194 which is necessary to run the piezo speaker 190 when the electronic circuit 22 is to generate an audible tone. The node 208 also splits current into the two zener regulated supplies 196 and 200. The current is split so that the microprocessor chip 28 will have a solid five volt reference, free of variations due to the loading of the light emitting diodes 24 and 26.

A reset for the microprocessor chip 28 is externally controlled so that, in the event of power failure, the microprocessor chip 28 does not attempt to execute software code in an undefined operating state. This reset is controlled at pin 210 on the microprocessor chip 28 through transistor 186. When voltage is first applied to the electronic circuit 22, the microprocessor chip 28 is held in reset until 2.7 volt zener diode 170 begins to conduct. When power is interrupted to the electronic circuit 22, the microprocessor chip 28 will remain operating until voltage across the zener diode 170 drifts below the zener voltage and zener diode 170 stops conducting. At this time, the difference in voltage between the base and emitter of transistor 186 lessens, and transistor 186 changes state, thus pulling the microprocessor chip 28 into reset until the diode 170 begins conducting again.

The software which is etched into the microprocessor chip 28 is configured to look for interrupts at a sixty Hertz rate in order to keep time and to multiplex the display of the light emitting diodes 24 and 26. Resistor 126 and capacitor 60 comprise a network that takes voltage off the diode bridge 160 and shapes sixty Hertz pulses to input pin 212 of the microprocessor chip 28.

Resistor 148 is connected to an internal oscillator in the microprocessor chip 28, and with internal capacitance within the microprocessor chip 28, determines the frequency corresponding to 1/RC. This is the time base of the microprocessor chip 28 and works to determine the speed at which the microprocessor chip 28 will execute the instructions of the software which is etched into the microprocessor chip 28.

Pins 214 of the microprocessor chip 28 provide output pulses that turn on the four digits of the light emitting diodes 24 and 26 that form the digital display 30. One digit at a time is turned on at a 25% duty cycle. The pulses are also matrixed as a 4×1 keyboard with pin 216 of the microprocessor chip 28 being the receiver. When pin 216 receives pulses, the microprocessor chip 28 knows which output is on and therefore decodes which input, keyboard switch 32, 34, 36 or 38, is being pushed. The display digit driver pulses run transistors 178, 180, 182 and 182 as emitter followers providing positive potential to operate the digits of the light emitting diodes 24 and 26 which form the digital display 30. The segments of the light emitting diodes 24 and 26 are operated by the microprocessor chip 28.

With the digits of the light emitting diodes 24 and 26 being supplied current through input 198 each digit singly at a 25% duty cycle, the segments of the light emitting diodes 24 and 26 are activated directly by the microprocessor chip 28, providing a path to system ground for each segment of the light emitting diodes 24 and 26 being activated. The software which is etched into the microprocessor chip 28 synchronizes which segments are to be turned on when each digit within the light emitting diodes is to be powered.

The electronic circuit 22 provides an audible tone at 2200 Hertz through the piezo beeper 190 whenever one of the input keys 32, 34, 36 or 38 is pressed or whenever the end of a timer cycle is finished. The piezo beeper 190 is excited as a collector load of transistor 188 (Class A) and has pulses across it from input 194 at twelve to thirteen volts. The microprocessor chip 28 will generate pulses of the 2200 Hertz audible tone frequency and the transistor 188 will switch on and off in response. With the voltage at that frequency, the piezo material forming the piezo beeper 190 will move which causes a noise to be made. The piezo beeper 190 has a resonant cavity molded in plastic in order to optimize sound output.

In connection with the electronic circuit 22 shown in FIG. 2, user operation of the input keys 32, 34, 36 and 38 along with the general functioning of the digital display 30 will now be described with relation to FIG. 3. FIG. 3 shows the digital display 30 and the input keys 32, 34, 36 and 38 as they would appear on a household oven. When power is first supplied to the electronic circuit 22, the digital display reads 88:88 and flashes for a few seconds before displaying a time of 12:00. The user has four input keys 32, 34, 36 and 38. Input key 32 allows the user to set the timer of the electronic circuit 22, and input key 34 allows the user to set the clock of the electronic circuit 22. Input key 36 allows the user to scroll the clock or timer up, and input key 38 allows the user to scroll the clock or timer down.

To set the clock of the electronic circuit 22, the user presses the clock set input key 34, and then presses the scroll up input key 36 and/or the scroll down input key 38 until the light emitting diodes 24 and 26 of the electronic circuit 22 which form the digital display 30 on the oven display the correct time. Then, the user would press the clock set input key 34 a final time. In this manner, the user can set the clock of the electronic circuit 22 shown in FIG. 2.

To set the timer of the electronic circuit 22, the user presses the timer set input key 32. At this time, the light emitting diodes 24 and 26 forming the digital display 30 on the over display 00:00 and a timer function light emitting diode 176 lights up. Then, the user can presses the scroll up input key 36 until the light emitting diodes 24 and 26 display the desired time to be counted down. Then, the user would press the timer set input key 32 a final time. At this time, the electronic circuit 22 would begin counting down the entered time. In this manner, the user can set the timer of the electronic circuit 22 shown in FIG. 2. When the electronic circuit has finished counting down the time, the electronic circuit 22 makes an audible sound through the piezo beeper 190, and continues to make the sound until the user manually returns the electronic circuit 22 to the clock mode. As mentioned, this is done by pressing the clock set input key 34.

By providing a reactive voltage drop within the electronic circuit 22 according to the present invention, the electronic circuit 22 eliminates the need for a transformer in order to provide that a high voltage power source can drive light emitting diodes. Eliminating the need for a transformer is desirable because transformers are relatively expensive and usually raise the overall cost of a circuit. Additionally, the reactive voltage drop within the electronic circuit 22 according to the present invention provides that voltage dropping resistors need not be used to drop voltage from the high voltage power source. Not having to use voltage dropping resistors is desirable because resistors create substantial heat as they drop voltage, and it is desirable to avoid generating internal heat within an electronic circuit. This is especially true when the electronic circuit is already within an environment which subjects the circuit to substantial heat, such as when the circuit is that of an oven. Finally, the reactive voltage drop of the electronic circuit 22 according to the present invention provides that inexpensive light emitting diodes can be utilized as a digital display and can be effectively driven be an inexpensive microprocessor chip.

While a preferred embodiment of the present invention is shown and described, it is envisioned that those skilled in the art may devise various modifications and equivalents without departing from the spirit and scope of the invention as defined by the appended claims. The invention is not intended to be limited by the foregoing disclosure.

The invention claimed is:

1. An electrical circuit for providing that an AC voltage power source can sequentially power at least three sets of light emitting elements without needing a transformer connected therebetween, said electrical circuit comprising:

a programmed microcontroller in driving connection with the at least three sets of light emitting elements such that said programmed microcontroller can sequentially drive the at least three sets of light emitting elements, wherein each set includes at least one light emitting element; and reactive drop circuitry connected to said programmed microcontroller and connectable to the AC voltage power source, wherein said reactive drop circuitry reduces the voltage and current transferred from the AC voltage power source to the at least three sets of light emitting elements through said programmed microcontroller, wherein said reactive drop circuitry reduces the voltage and current without utilizing a transformer.

2. The electrical circuit as recited in claim 1, said reactive drop circuitry communicating a single pulse to said programmed microcontroller.

3. The electrical circuit as recited in claim 1, said programmed microcontroller sequentially driving said at least three sets of light emitting elements one at a time.

4. The electrical circuit as recited in claim 1, each of said light emitting elements comprising a light emitting diode.

5. The electrical circuit as recited in claim 1, further comprising a plurality of switches connected to each light emitting element and to said programmed microcontroller, said programmed microcontroller decoding which of said switches is actuated.

6. The electrical circuit as recited in claim 1, said programmed microcontroller driving said at least three sets of light emitting elements in a sequence defined by software etched into said programmed microcontroller, said sequence being generally independent in relation to half-cycles of the AC voltage power source.

7. The electrical circuit as recited in claim 1, said reactive drop circuitry communicating a single pulse to said programmed microcontroller, said programmed microcontroller sequentially driving said at least three sets of light emitting elements one at a time in a sequence defined by software etched into said programmed microcontroller, said sequence being generally independent in relation to half-cycles of the AC voltage power source.

8. A transformerless digital display circuit connectable to and powerable by a high voltage power source, said transformerless digital display circuit comprising:

at least three sets of light emitting elements;

a microcontroller connected to the at least three sets of light emitting elements, wherein said microcontroller can sequentially transfer power and voltage to said at least three sets of light emitting elements when the transformerless digital display circuit is connected to, and powered by, the high voltage power source;

electrical circuitry connected to said microcontroller, wherein said electrical circuitry reduces the voltage and current which is provided to said microcontroller and said sets of light emitting elements by the high voltage power source when the transformerless digital display circuit is connected to, and powered by, the high voltage power source, and wherein said electrical circuitry adequately reduces the voltage and current which is provided to said microcontroller and said sets of light emitting elements by the high voltage power source without utilizing a transformer.

9. The electrical circuit as recited in claim 8, said electrical circuitry communicating a single pulse to said microcontroller.

10. The electrical circuit as recited in claim 8, said microcontroller sequentially driving said at least three sets of light emitting elements one at a time.

11. The electrical circuit as recited in claim 8, each of said light emitting elements comprising a light emitting diode.

12. The electrical circuit as recited in claim 8, further comprising a plurality of switches connected to each light emitting element and to said microcontroller, said microcontroller decoding which of said switches is actuated.

13. The electrical circuit as recited in claim 8, said microcontroller driving said at least three sets of light emitting elements in a sequence defined by software etched into said microcontroller, said sequence being generally independent in relation to half-cycles of the power source.

14. The electrical circuit as recited in claim 8, said electrical circuitry communicating a single pulse to said microcontroller, said microcontroller sequentially driving said at least three sets of light emitting elements one at a time in a sequence defined by software etched into said microcontroller, said sequence being generally independent in relation to half-cycles of the power source.

15. An electrical circuit for allowing a 120 Volt AC power source to provide a current of about 100 milliamps at a voltage of about 5 Volts to digital display circuitry without having to utilize a transformer within the electrical circuit to reduce the voltage received by the digital display circuitry from the 120 Volt AC power source, said electrical circuit comprising:

at least three sets of light emitting elements forming a digital display;

a microcontroller in driving connection with said at least three sets of light emitting elements such that said microcontroller can sequentially drive the at least three sets of light emitting elements, wherein each set includes at least one light emitting element; and a reactive element connected between the power source and said microcontroller, wherein said reactive element reduces the voltage transferred from said power source to said microcontroller by 95 Volts.

16. An electrical circuit connectable to a 120 Volt AC power source, said electrical circuit comprising:

a programmed microcontroller;

at least three sets of light emitting elements connected to, and driven by, said programmed microcontroller such that said programmed microcontroller can sequentially drive the at least three sets of light emitting elements, wherein each set includes at least one light emitting element;

current and voltage dropping circuitry, wherein said current and voltage dropping circuitry provides a reactive voltage drop from the 120 Volt AC power source when the electrical circuit is connected thereto, wherein said reactive voltage drop provides that the 120 Volt AC power source can power said light emitting elements without having to provide a transformer between the 120 Volt AC power source and said light emitting elements.

17. A transformerless digital display circuit connectable to and powerable by a 120 Volt AC power source, said transformerless digital display circuit comprising:

at least three sets of light emitting elements;

a 20 pin microcontroller connected to said at least three sets of light emitting elements such that said microcontroller sequentially drives the at least three sets of light emitting elements, wherein each set includes at least one light emitting element, said microcontroller having 2 Kbytes of 8 bit read only memory, said microcontroller having software etched therein, wherein said microcontroller can sequentially transfer power and voltage to said sets of light emitting elements when the transformerless digital display circuit is connected to, and powered by, the high voltage power source, and wherein said software detects whether a resistor is connected to said microcontroller and converts a pin on the microcontroller from an input into said microcontroller from said 120 Volt AC power source to an output from said microcontroller to at least one light emitting element; and electrical circuitry connected to said microcontroller, wherein said electrical circuitry reduces the voltage and current which is provided to said microcontroller and said light emitting elements by the high voltage power source when the transformerless digital display circuit is connected to, and powered by, the high voltage power source, and wherein said electrical circuitry adequately reduces the voltage and current which is provided to said microcontroller and said light emitting elements by the high voltage power source without utilizing a transformer.

18. The transformerless digital display circuit as defined in claim 17, wherein said software synchronizes with the frequency of the 120 Volt AC power source to provide that the microcontroller keeps track of time.

19. A transformerless digital oven timer on an oven connectable to and powerable by an electrical outlet providing 120 Volts of AC power, said transformerless digital oven timer comprising:

at least three sets of light emitting elements;

a 20 pin microcontroller connected to said light emitting elements such that said microcontroller sequentially drives the at least three sets of light emitting elements, wherein each set includes at least one light emitting element, said microcontroller having 2 Kbytes of 8 bit read only memory, said microcontroller having software etched therein, wherein said microcontroller can sequentially transfer power and voltage to said light emitting elements when the oven is connected to, and powered by, the electrical outlet, wherein said software detects whether a resistor is connected to said microcontroller and converts a pin on the microcontroller from an input into said microcontroller to an output from said microcontroller, and wherein said software synchronizes the microcontroller with the frequency of the power provided by the electrical outlet to provide that the microcontroller keeps track of time; and electrical circuitry connected to said microcontroller, wherein said electrical circuitry reduces the voltage and current which is provided to said microcontroller and to said light emitting elements by the electrical outlet when the oven is connected to, and powered by, the electrical outlet, wherein said electrical circuitry adequately reduces the voltage and current which is provided to said microcontroller and to said light emitting elements by the electrical outlet without utilizing a transformer, and wherein said electrical circuitry provides real resistance to reject noise from the electrical outlet.

* * * * *